US005181651A

United States Patent [19]

Oppenheim

[11] Patent Number: 5,181,651

[45] Date of Patent: Jan. 26, 1993

[54] PAPERBOARD ASPARAGUS CARTON

[75] Inventor: Paul J. Oppenheim, San Jose, Calif.

[73] Assignee: International Paper Company, Purchase, N.Y.

[21] Appl. No.: 833,276

[22] Filed: Feb. 10, 1992

[51] Int. Cl.[5] ..... B65D 5/42

[52] U.S. Cl. ..... 229/121; 229/120; 229/122; 229/148; 229/149; 229/168; 229/DIG. 14

[58] Field of Search ..... 229/120, 121, 122, 126, 229/148, 149, 150, 162, 168, 164, DIG. 14

[56] References Cited

U.S. PATENT DOCUMENTS

| | | | |
|---|---|---|---|
| 1,602,702 | 10/1926 | Pinkerton . | |
| 1,852,527 | 4/1932 | King . | |
| 2,361,124 | 10/1944 | Ringholz . | |
| 2,577,304 | 12/1951 | Brooks . | |
| 2,698,126 | 12/1954 | Belsinger . | |
| 2,757,853 | 8/1956 | Main . | |
| 2,858,058 | 10/1958 | Kitchell . | |
| 3,143,275 | 8/1964 | Diggs . | |
| 3,203,613 | 8/1965 | Stowe . | |
| 3,695,505 | 10/1972 | Wolf | 229/126 |
| 3,863,829 | 2/1975 | Merrill | 229/120 |
| 3,881,648 | 5/1975 | Hall | 229/120 |
| 3,924,801 | 12/1975 | Partain | 229/168 |
| 3,998,379 | 12/1976 | Myers et al. . | |
| 4,105,152 | 8/1978 | Elward | 229/164 |
| 4,187,976 | 2/1980 | Mather | 229/168 |
| 4,265,391 | 5/1981 | Zornes et al. | 229/168 |
| 4,313,547 | 2/1982 | Osborne | 229/122 |
| 4,353,495 | 10/1982 | Jes . | |
| 4,529,117 | 7/1985 | Brundage . | |
| 4,817,861 | 4/1989 | Henrikson | 229/122 |

FOREIGN PATENT DOCUMENTS

| | | | |
|---|---|---|---|
| 411279 | 2/1991 | European Pat. Off. | 229/121 |

*Primary Examiner*—Gary E. Elkins
*Attorney, Agent, or Firm*—Walt Thomas Zielinski

[57] ABSTRACT

An asparagus carton and a unitary blank for forming it. The blank is of corrugated paperboard. The carton interior is tapered along opposite side walls by virtue of slanting side spacer panels. This yields a trapezoidal configuration of a part of the carton interior to more nearly correspond to the tapered form of a mass of asparagus. The carton is preferably loaded from the bottom. The asparagus may be inspected by opening a side wall panel, and may also be opened from the top. In addition to providing slanting side walls, the side spacer panels permit the loaded carton to be lifted through side wall openings without contacting the asparagus. In a first embodiment, the bottom of the carton may be opened by releasing a bottom tongue and slot latch arrangement, while in a second embodiment the bottom of the carton is defined by known interlocking panels.

11 Claims, 5 Drawing Sheets

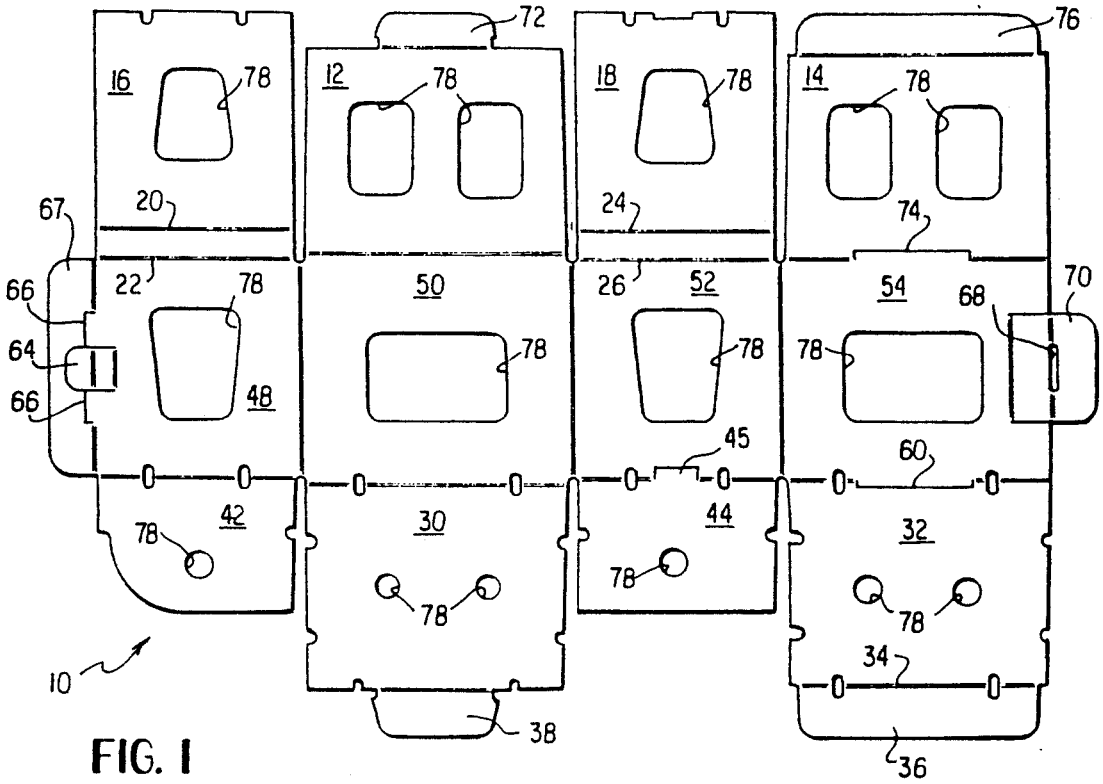
FIG. 1
FIG. 4
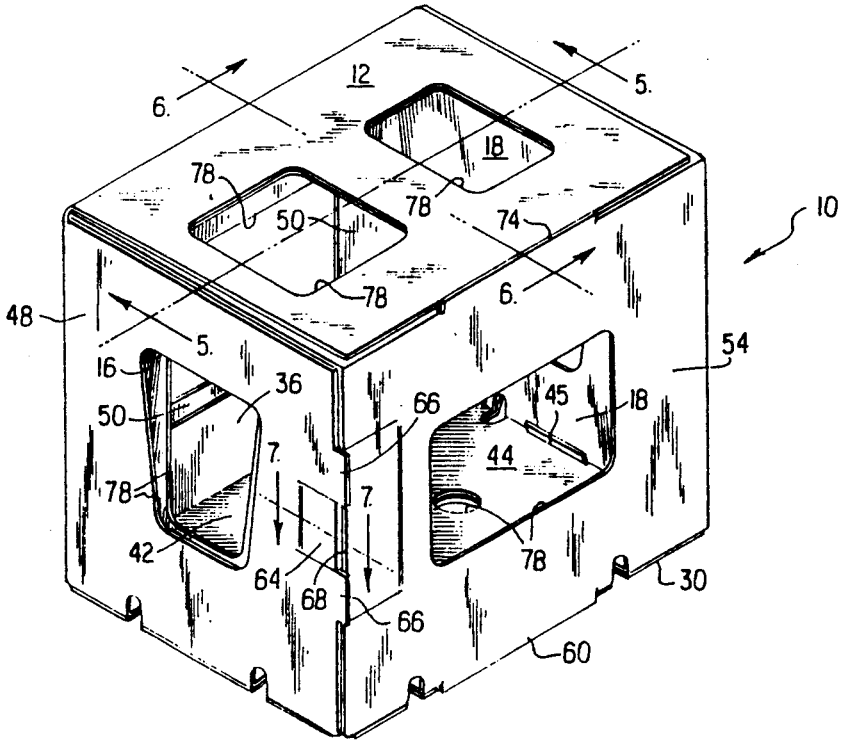

PAPERBOARD ASPARAGUS CARTON

BACKGROUND OF THE INVENTION

This invention relates to an asparagus carton fashioned from a unitary blank of stiff, foldable, and resilient sheet material, such as corrugated paperboard or the like.

The paperboard carton art is aware of constructions for forming an asparagus carton from a unitary blank of paperboard. One construction is shown in U.S. Pat. No. 4,353,495 issued to OHo H. Jes. The Jes carton includes openings for the introduction of fluids to cool the asparagus after it has been placed in the carton. However, the Jes carton requires staples for assembly. There exists a need for a paperboard asparagus carton having opposite interior side slanted spacer panels, spaced a predetermined distance from two of the four side panels, for the purpose of protecting the contents of the carton and also to rigidify it with regard to vertical stacking strength, and which does not require staples for its erection.

SUMMARY OF THE INVENTION

Accordingly to the practice of this invention, a corrugated paperboard asparagus container is fashioned from a unitary blank, with the carton being in the general form of a rectangular parallelepiped. The bottom closure for the carton may assume one of two forms, with each form including a plurality of overlapped or superposed bottom panels which are, in turn, foldably joined to the bottoms of respective side panels of the carton. The top closure for the carton is defined by a pair of overlapping panels, also superposed, with the uppermost of the top closure panels carrying a tab which is received by a slot at the base of the other top closure panel. Interior side spacer panels are joined to two opposite side panels of the carton by a double fold line, i.e., two fold lines parallel to each other and spaced apart. The side spacer panels are tilted slightly so as to yield a trapezoidal carton interior.

The carton walls are provided with openings to permit hydro cooling of the asparagus. The wall openings, in combination with the tilted side spacer panels, permit lifting of the filled carton without contacting the asparagus.

The carton may be opened from the top, or the bottom, or from a side, the latter mode facilitating inspection of the asparagus. The carton may be side loaded after the top and bottom are assembled.

BRIEF DESCRIPTION OF THE DRAWINGS

FIG. 1 is a plan view of the unitary blank of corrugated paperboard for forming the carton of this invention.

FIG. 4 is a perspective view of the fully erected and closed carton.

DETAILED DESCRIPTION OF THE INVENTION

Figure 2:
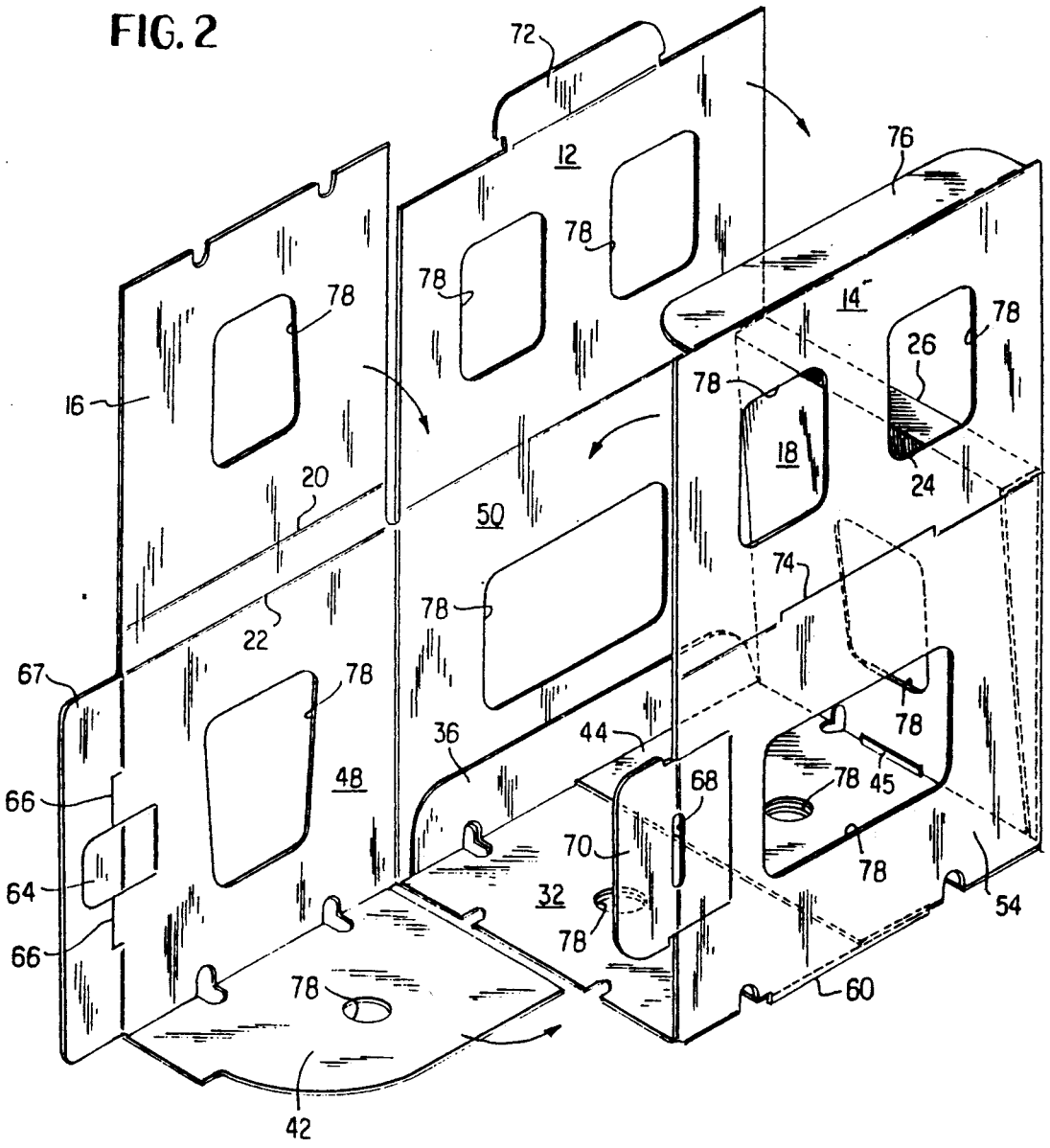
FIG. 2 is a perspective view illustrating an intermediate stage in erecting the carton from the blank of FIG. 1.

Referring now to FIG. 1 of the drawings, the numeral 10 denotes generally a unitary blank of corrugated paperboard or other stiff, resilient, and foldable sheet material, with the blank generally rectangular in form and divided into panels and latching tabs by a plurality of horizontally and vertically extending fold lines as indicated. The blank includes four upper panels which include top closure panels 12 and 14 and side spacer panels 16 and 18. Parallel fold lines 20 and 22 are located at the bottom of panel 16, while corresponding fold lines 24 and 26 are located at the bottom of panel 18.

Bottom forming panels 30 and 32 are foldably joined at their upper edges to respective side panels, the latter shortly to be described. Panel 32 is provided at its lower end with a fold line 34 which forms a flap 36. The lower edge of bottom forming panel 30 is provided with a bottom latching tab 38, foldably attached thereto by a fold line similar to 34. Additional partial bottom forming panels 42 and 44 are foldably joined to the lower edges of respective side panels. Cut lines in the center of the fold joining panels 44 and 52 define a tab 45.

Referring now to the side wall or middle panels of FIG. 1, side wall panels 48, 50, 52, and 54 and are foldably joined to each other by the indicated vertically extending fold lines, and also foldably joined to respective top and bottom panels by horizontally extending fold lines as indicated. Cut line 60, having the indicated short vertically extending cut portions at its ends, and defining a bottom latching slot is substantially coincident with the horizontal fold line joining panels 32 and 54.

Latching tuck tab 64 at the left or free edge of side panel 48 is defined by the indicated cut and fold lines, a part of this tab positioned between vertically extending cut lines 66, the latter each having a short horizontally extending portion, as indicated. Tuck tab 64 is adapted to be received in slot 68 in side latching tab 70, tab 70 being foldably joined to the free or right end of side panel 54. The left or free end of side panel 48 is provided with a flap 67. Tab 64 and slot 68, together with tab 70, define means for joining the free edges of respective side panels 54 and 48. Tab 64 and 70 cut lines 66, slot 68, together with flap 67, permit side opening of the carton.

Top tab 72 is foldably joined to the top of outermost top closure panel 12, with tab 72 being adapted to enter a slot defined by horizontally extending cut line 74, the latter having short vertically downwardly extending cut portions at its ends as illustrated. Innermost top closure panel 14 is provided at its upper edge with foldable flap 76 defined by the indicated fold line.

Figure 3:
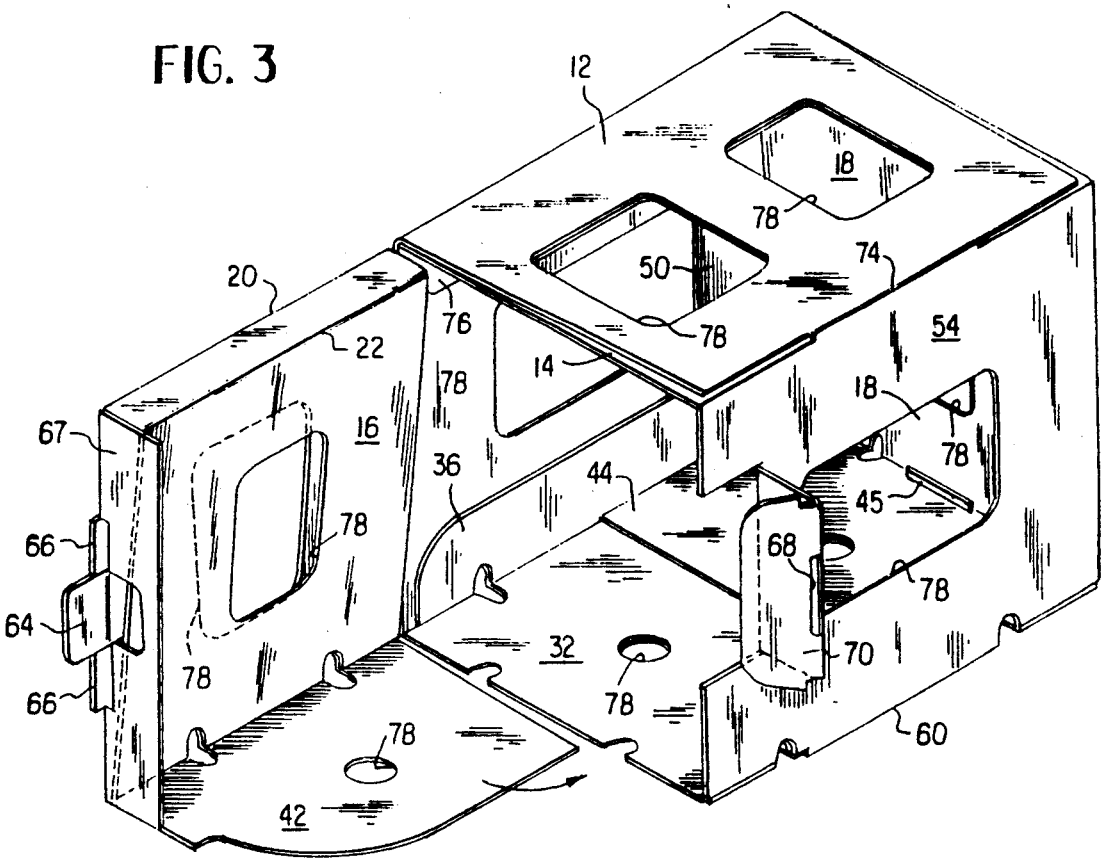
FIG. 3 is a perspective view of the fully erected carton opened from the side ready for loading or for inspection.

To erect the container from the blank, the four side wall panels 48, 50, 52, and 54 are folded to a rectangular tube form, with flap 76 abutting the upper interior portion of side wall 50. Outer top closure panel 12 is folded over inner top closure panel 14, and tab tuck 72 inserted into top closure locking slot 74. As shown at FIGS. 3 and 4, side spacer panel 18 is folded down and is tilted slightly due to the spacing between fold lines 24 and 26. The bottom closure is formed by folding the lower panels 42, 44 inwardly after folding upper bottom panel 32 inwardly and inserting its flap 36 next to the interior of side wall panel 50. Lower or outer bottom panel 30 is folded inwardly and its tab 38 inserted into the slot defined by cut 60.

Figure 7:
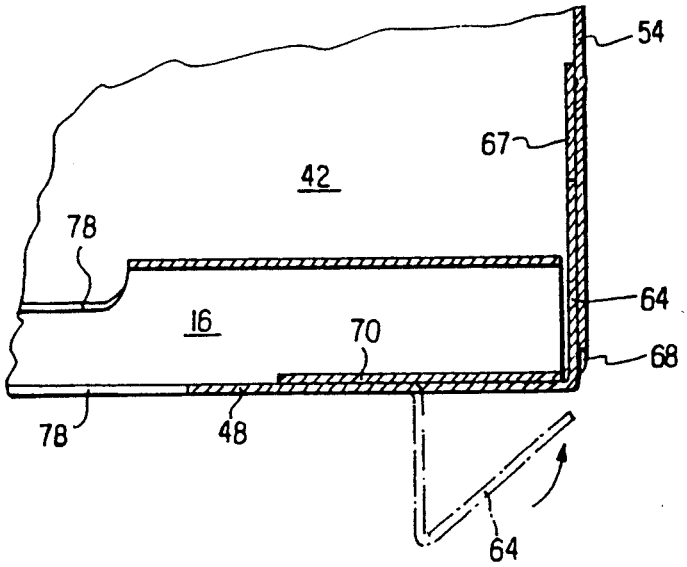
FIG. 7 is a view along section 7—7 of FIG. 4.

Side spacer panel 16 is folded about its fold lines 20, 22 so as to lie tilted with respect to side wall panel 48. As shown at FIG. 3, side wall 48 and its tilted side spacer panel 16, and bottom panel 42 are rotated, as shown by the curved arrow, to close the carton. Flap 67 engages the interior left surface of side 54. Tab 70 is inserted into the slot defined by cut lines 66, and tab 64 inserted into side panel latching slot 68, as also shown at FIG. 7. The carton is now closed and releasably latched at the top, the bottom, and at one side wall. As may be seen at FIG. 5, fingers of a handler can be inserted into opposite outer side openings 78 of sides 48 and 52 to lift the carton without contacting the asparagus.

Figure 5:
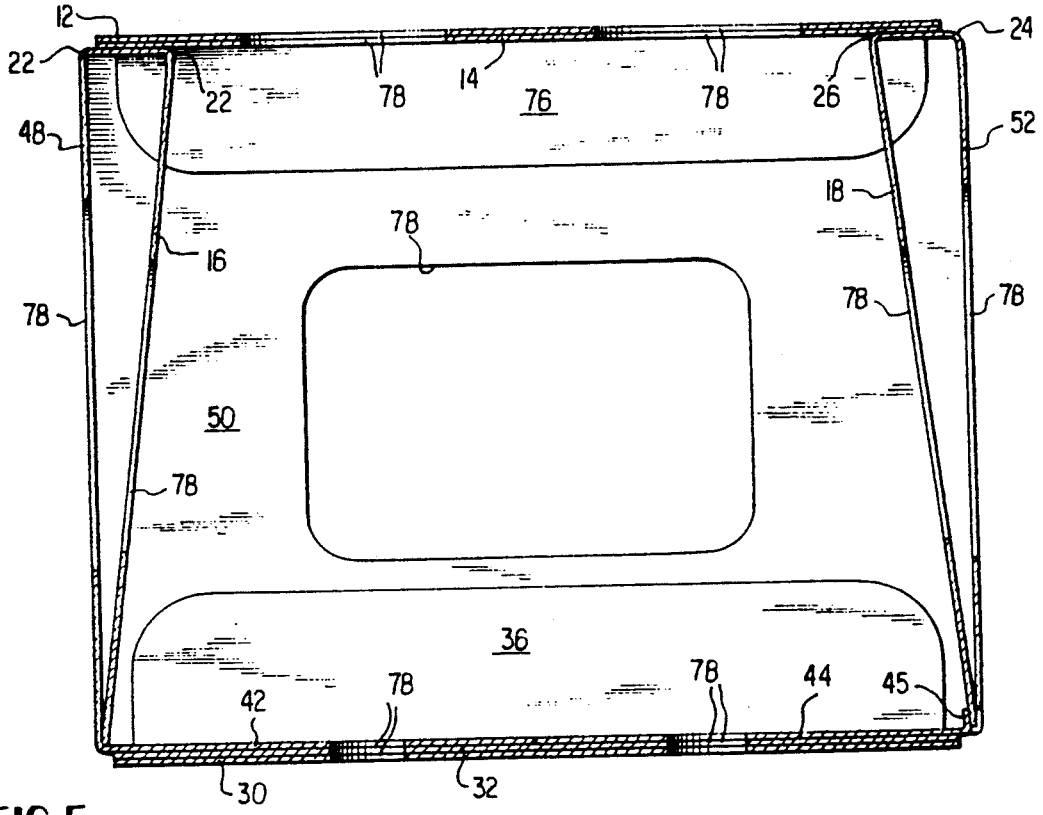
FIG. 5 is a view along section 5—5 of FIG. 4.
Figure 6:
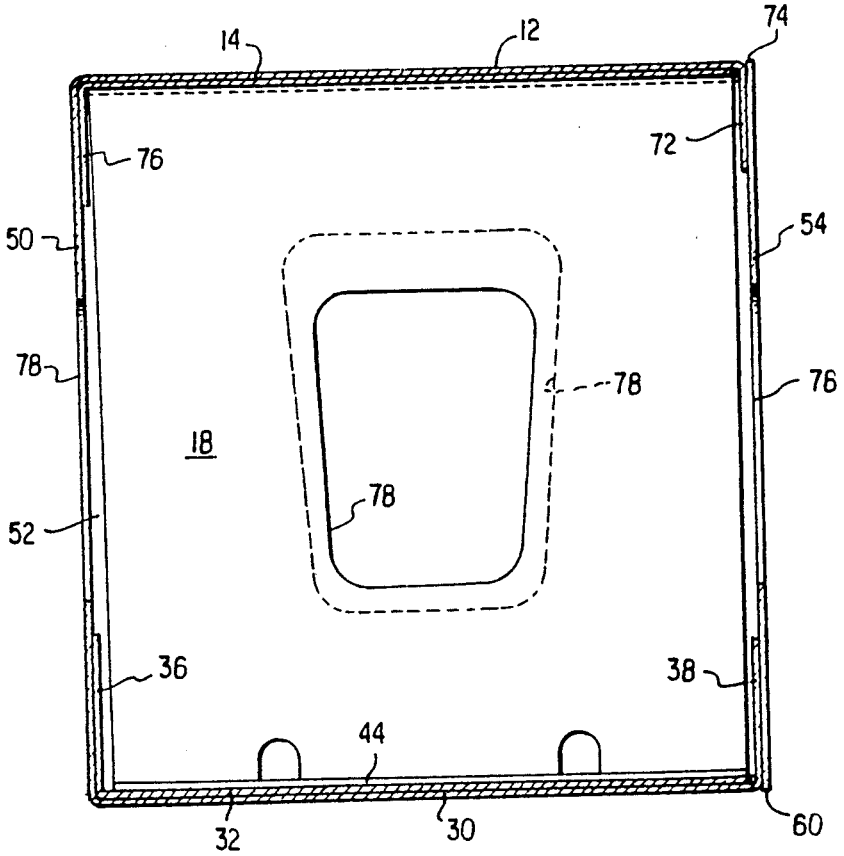
FIG. 6 is a view along section 6—6 of FIG. 4.

In practice, when loading asparagus into the carton, the top and the bottom are closed and the asparagus (tips upward) inserted through the side of the open carton, as shown at FIG. 3. The asparagus are precut to a desired length (to permit additional growth between packaging and final consumption) prior to loading into the carton. Side panels 16 and 18 make the slight tilt or angle with respect to the side panels 48, 52 such that the top of the carton interior is narrower than the bottom. The asparagus tips are at the top of the carton interior, with the larger diameter stalk ends resting on bottom panels 42 and 44. As shown at FIGS. 3-5, tab 45 assists in holding the bottom of side spacer panel 18. The opposite, slanting side spacer panels 16, 18 thus partially conform, on two sides, the carton interior to the shape of the mass of asparagus therein.

Figure 8:
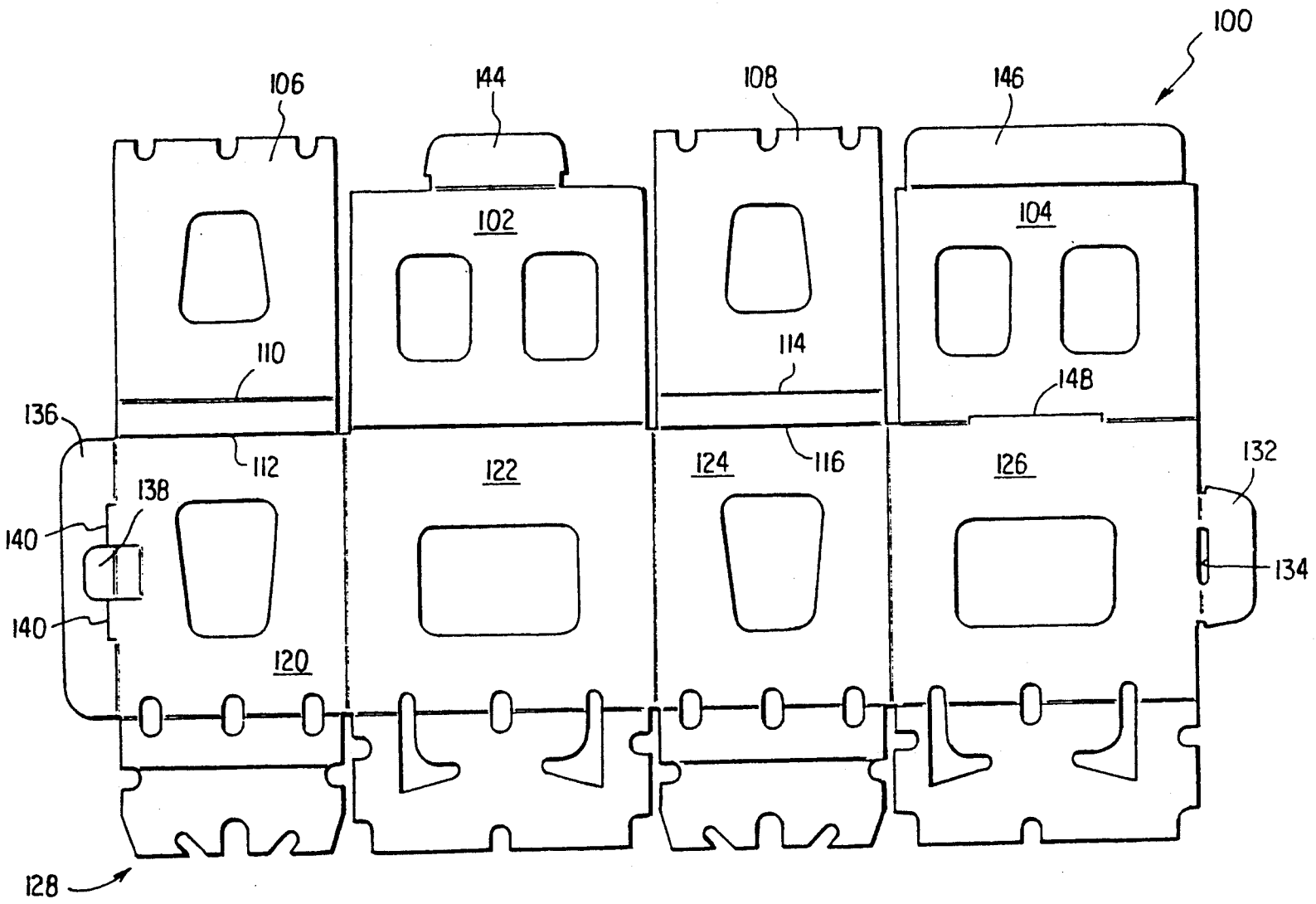
FIG. 8 is a plan view, similar to FIG. 1, of a modified blank for forming the carton of this invention.

Referring now to FIG. 8 of the drawings, the numeral 100 denotes a unitary blank of corrugated paperboard similar to blank 10 previously described. Top closure panels 102 and 104 correspond to previously described top closure panels 12 and 14, while side spacer panels 106 and 108 correspond to previously described side spacer panels 16 and 18. Again, each side spacer panel is coupled at its lower end to the remaining portions of the blank by means of parallel, spaced fold lines 110, 112, and 114, 116, respectively. Side wall forming panels 120, 122, 124, and 126 correspond to previously described side panels 48, 50, 52, and 54. The left or free edge of side panel 120 is provided with a flap 136, of the same vertical height as panel 120, with panel 120 also carrying a latching tongue 138 defined by the indicated cut and fold lines. Vertically extending cut 140, having a short horizontal extension at each end is interrupted by tab 138. The right hand or free edge of side panel 126 is provided with a tab 132 having a slot 134 in its base, with tab 132 foldably joined to the free edge of panel 126.

A plurality of bottom closure panels is denoted collectively as 128, with each of these panels foldably secured to a lower respective side panel 120, 122, 124, and 126. Bottom forming panels 128 are of a conventional construction, known in the art, as for example from Austrian Patent 218,420 of 1961 issued to Stocklasek, and form no part of this invention. To form a carton from the blank 100, the same steps are followed as those previously described, except that the bottom closure is formed by folding and locking panels 128 in a known manner.

To load a carbon formed from the blank the FIG. 8, the blank is folded and the top and sides of he carton are closed. Asparagus are loaded into the carton from the bottom, with a spacer (such as a one inch thick board of any construction) first inserted against the interior surface of the carton top. With the asparagus in the carton loaded from the bottom with tips toward the top, the bottom closure panels 128 are folded against the outer carton sides, and those portions of the asparagus which extend beyond the carton bottom end are removed as by cutting. The bottom closure panels are now closed. The spacer is then removed as by opening the carton top or side and then releasing. The spacer is removed to permit natural lengthwise growth of the asparagus between the time of packaging and the time of removal from the carton.

I claim:

1. A paperboard carton formed from a unitary corrugated paperboard blank, the carton having a top closure, four side panels, each said side panel having a lower edge and an upper portion, and a bottom closure, said bottom closure including a plurality of at least partially overlapped bottom panels, said bottom panels foldably joined to respective lower edges of said side panels, said four side panels forming a rectangular tube, having three vertical edges formed by integral junctions of the side panels, two adjacent said side panels each having a free edge to thereby define two free side panel edges, first means releasably joining said free side panel edges together to form a fourth vertical edge of said rectangular tube, said top closure including two at least partially overlapped top panels, each of said at least two top panels foldably joined to the upper portion of a respective side panel, one of said at least two top panels having second means for securing it to the carton to releasably close it to the carton, two opposite of said four side panels each having a side spacer panel foldably joined to the upper end of a respective said opposite side panel, each side spacer panel positioned interiorly of the carton, whereby the carton can be releasably opened from either the top, or from one side.

2. The carton of claim 1 wherein one of said top panels carries a top tab, said top tab received in a top closure locking slot, said top tab and said top locking slot defines said second means.

3. The carton of claim 1 wherein said first means includes a side latching tab whose base is provided with a side panel latching slot and a tuck tab also carried by the free edge of the other of said side panels having a free edge, said tuck tab received by said side panel latching slot, said first means detachably joining said free side edges.

4. The carton of claim 1 wherein said side spacer panels are foldably joined to their respective side panels by two parallel fold lines.

5. The carton of claim 1 wherein the side panels which are joined to said side spacer panels are shorter in height than the other side panels.

6. The carton of claim 1 wherein the side spacer panels extend from the top to the bottom of the carton.

7. The carton of claim 1 wherein said bottom closure includes a pair of oppositely disposed panels having, respectively, a bottom latching tab and tab receiving slot, to thereby releasably close the carton bottom.

8. The carton of claim 1 wherein the opposite side panels which carry said side spacer panels each carry at their respective lower edges a partial bottom forming panels, said partial bottom forming panels being coplanar.

9. The carton of claim 1 wherein said bottom closure is defined by four panels each foldably secured to the lower edge of a respective side panel, any one bottom panel being interlocked with two adjacent bottom panels.

10. A unitary paperboard blank for forming a carton of generally rectangular parallelepiped shape, the blank having a plurality of horizontal and vertical fold lines defining a plurality of panels, four side panels foldably secured in a horizontal row together in series, the row having two middle and two endmost panels, each said side panel having an upper and a lower portion, each of the two endmost of said four side panels having a free side edge not connected to any other of said panels, each free edge having means to couple it to the other free edge, to thereby permit the formation of a rectangular tube, said means allowing opening and reclosing of one of said side panels when the carton is formed, a plurality of bottom forming panels secured to respective lower portions of at least some of said side panels, a side spacer panel foldably secured to the upper portion of each of two alternate of said side panels by spaced, horizontal, parallel fold lines, a top closure panel foldably joined to the upper portion of at least one of the remaining two, non-alternate side panels of said four side panels.

11. The blank of claim 10 wherein both of the remaining said two, non-alternate side panels, are provided with a respective top closure panel foldably joined to the upper portion of the remaining two, non-alternate side panels.

* * * * *